US006302961B1

(12) United States Patent
Robie et al.

(10) Patent No.: US 6,302,961 B1
(45) Date of Patent: Oct. 16, 2001

(54) APPARATUS FOR APPLYING A LIQUID COATING TO ELECTRICAL COMPONENTS

(75) Inventors: Paul M. Robie; Stephen L. Fallen, both of Ennis; Stephen R. Passariello, Argyle, all of TX (US)

(73) Assignee: Ennis Automotive, Inc., Ennis, TX (US)

( * ) Notice: Subject to any disclaimer, the term of this patent is extended or adjusted under 35 U.S.C. 154(b) by 0 days.

(21) Appl. No.: 09/351,343

(22) Filed: Jul. 12, 1999

(51) Int. Cl.[7] ..... B05C 5/02

(52) U.S. Cl. ..... 118/66; 118/315; 118/319; 118/320; 118/503

(58) Field of Search ..... 118/66, 315, 319, 118/320, 503; 427/104, 116, 318, 425

(56) References Cited

U.S. PATENT DOCUMENTS

| | | | | |
|---|---|---|---|---|
| 2,572,515 | | 10/1951 | Poole et al. . | |
| 2,574,686 | | 11/1951 | Brown . | |
| 2,821,158 | | 1/1958 | Brown et al. . | |
| 3,261,707 | | 7/1966 | Korski et al. . | |
| 3,355,310 | | 11/1967 | De Jean et al. . | |
| 3,384,048 | | 5/1968 | Kutcher . | |
| 3,524,429 | | 8/1970 | Wilding . | |
| 3,607,553 | * | 9/1971 | Fritzsche . | |
| 3,832,211 | * | 8/1974 | Cook et al. | 118/56 |
| 4,311,111 | * | 1/1982 | Inaba | 118/56 |
| 4,559,698 | | 12/1985 | Bair et al. . | |
| 4,616,593 | * | 10/1986 | Kawamura et al. | 118/303 |
| 4,792,462 | | 12/1988 | Smith et al. . | |
| 4,963,391 | | 10/1990 | Bair et al. . | |
| 5,401,531 | | 3/1995 | Faraoni et al. . | |
| 5,474,799 | | 12/1995 | Thigpen et al. . | |
| 5,624,496 | * | 4/1997 | Scharf et al. | 118/320 |

* cited by examiner

*Primary Examiner*—Laura Edwards
(74) *Attorney, Agent, or Firm*—Akin, Gump, Strauss, Hauer & Feld, LLP

(57) ABSTRACT

An apparatus for applying a hardenable or curable liquid coating, such as "varnish" to workpieces, such as electric motor rotor or stator conductor windings comprises a rotary table having plural workpiece supports mounted on the table circumferentially spaced and radially outwardly projecting. Rotatable stator grippers or rotor support heads are mounted at each support and are drivenly engaged with a drive mechanism, including a drive shaft assembly which is operably connected to a ring gear disposed centrally on the table and coaxial with the axis of rotation of the table. The ring gear is drivenly connected to a variable speed drive motor. Electric alternator stator members may be mounted at each support by a releasable pneumatically actuated gripper assembly which is mounted for rotation by a retractable friction wheel connected to the drive shaft assembly. Retractable induction heaters are disposed adjacent to the table for movement between working and non-working positions to heat workpieces prior to application of the liquid coating at a coating applicator station. A pressure fluid rotary coupling unit is operable to distribute pressure fluid to each workpiece support. The rotary table is mounted on a rotary indexable actuator. A control system, including a programmable logic controller, controls operation of the actuator, the drive mechanism drive motor, engagement and release of the workpieces, rotation of the workpieces, and operation of the workpiece heaters and liquid applicator nozzles.

29 Claims, 12 Drawing Sheets

APPARATUS FOR APPLYING A LIQUID COATING TO ELECTRICAL COMPONENTS

FIELD OF THE INVENTION

The present invention pertains to a multi-station apparatus for processing workpieces and is particularly adapted for applying a hardenable liquid coating to electrical components, such as to the windings of electrical generator or motor rotors or stators.

BACKGROUND

In the art of manufacturing and remanufacturing electric motors and generators the rotor or stator electrical conductor windings are typically coated with a hardenable or curable coating or "varnish" to act as an insulator and as means for retaining the windings in their proper position. Several problems have persisted in the manufacture and remanufacture of electrical components, such as automotive type electrical generators or alternators, wherein the application of a varnish-like coating to the electrical conductor windings of the rotor and stator members, in particular, has been a difficult operation. Dipping the entire rotor or stator member into a bath or shower of the liquid coating is undesirable in that the coating adheres to portions of the structures which interfere with assembly and operation of the associated electrical device. Prior art efforts to "paint" on or spray on such coatings has often resulted in uneven or incomplete distribution of the coatings through the windings.

Immersing the component in the coating or bathing the entire component with the liquid coating or "varnish" has been carried out in order to assure that the coating completely penetrates the bundled electrical conductor windings to properly bind them and insulate them. However, problems associated with removing the coating from certain portions of the component have persisted. Moreover, the high volume production or reconditioning of electrical generators and motors has also dictated a need to develop apparatus and processes for applying liquid coatings to generator or motor windings which are capable of high volume production rate processing.

Accordingly, there has been a strong need to develop apparatus for applying liquid coatings or "varnish" to electrical components, such as electrical generator or motor rotor or stator members, which overcomes the problems associated with prior art methods of manufacturing and remanufacturing such components. It is to these ends that the present invention has been developed.

SUMMARY OF THE INVENTION

The present invention provides an improved apparatus for carrying out a manufacturing process on a workpiece and which is particularly adapted for applying a liquid coating to the electrical conductor windings of electrical components, such as electric motor or generator rotor or stator members, for example.

In accordance with one important aspect of the present invention and apparatus is provided for handling multiple workpieces to preheat the workpieces, apply a curable or hardenable liquid coating to the workpieces, allow predetermined residence time of the workpieces on the apparatus to provide for curing or hardening of the coating and to release engagement of the workpieces seriatim for removal from the apparatus and for loading of new workpieces onto the apparatus.

In particular, the apparatus is characterized by multiple workpiece supporting members which are each operable to releasably grip a workpiece and to rotate the workpiece substantially continuously to provide for applying a hardenable liquid coating uniformly thereto, and to provide for even distribution of the coating throughout the workpiece while allowing the coating to harden or cure. The multiple support members also are operable to provide for removal of each workpiece from the apparatus and replacement by other workpieces which require processing in accordance with the operations performed by the apparatus. In this regard, the apparatus is provided with plural workpiece support members mounted on a rotary table and circumferentially spaced about the periphery of the table. The table is rotatable by an indexing type actuator to provide for multi-stage sequential treatment of the workpieces, including two stages of preheating the workpieces, application of a liquid coating to the workpieces and further indexing of the workpieces back to a loading and unloading position for each workpiece.

In accordance with another aspect of the present invention an apparatus is provided for supporting workpieces comprising electrical components, such as electrical generator stator or rotor members, wherein the rotor or stator workpieces are releasably supported on a fixture which provides for rotation of the workpieces at a predetermined rate whereby a liquid coating may be applied to certain portions of the workpieces uniformly without spillage or unwanted distribution of the coating to other parts of the workpieces. The multi-station turntable type apparatus of the invention provides for retaining multiple workpieces on the apparatus for a predetermined residence time to allow curing or hardening of the coating after application thereof.

In accordance with yet a further aspect of the present invention a multi-station apparatus is provided which is particularly adapted for releasably supporting a plurality of workpieces, such as electrical generator stator members, wherein the stator members are releasably gripped by remotely controllable gripper assemblies at plural support members, respectively, on the apparatus. The workpieces are rotatably indexed while being supported on their respective gripper assemblies for movement to positions for heating the workpieces, then to a position for application of the liquid coating to windings of the rotor or stator workpiece and then subsequent rotational indexing back to a load and unload station or position to allow curing or hardening of the coating applied to the workpieces, respectively.

Those skilled in the art will further appreciate the advantages and superior features of the invention together with other important aspects thereof upon reading the detailed description which follows in conjunction with the drawings.

DETAILED DESCRIPTION OF PREFERRED EMBODIMENTS

Figure 1:
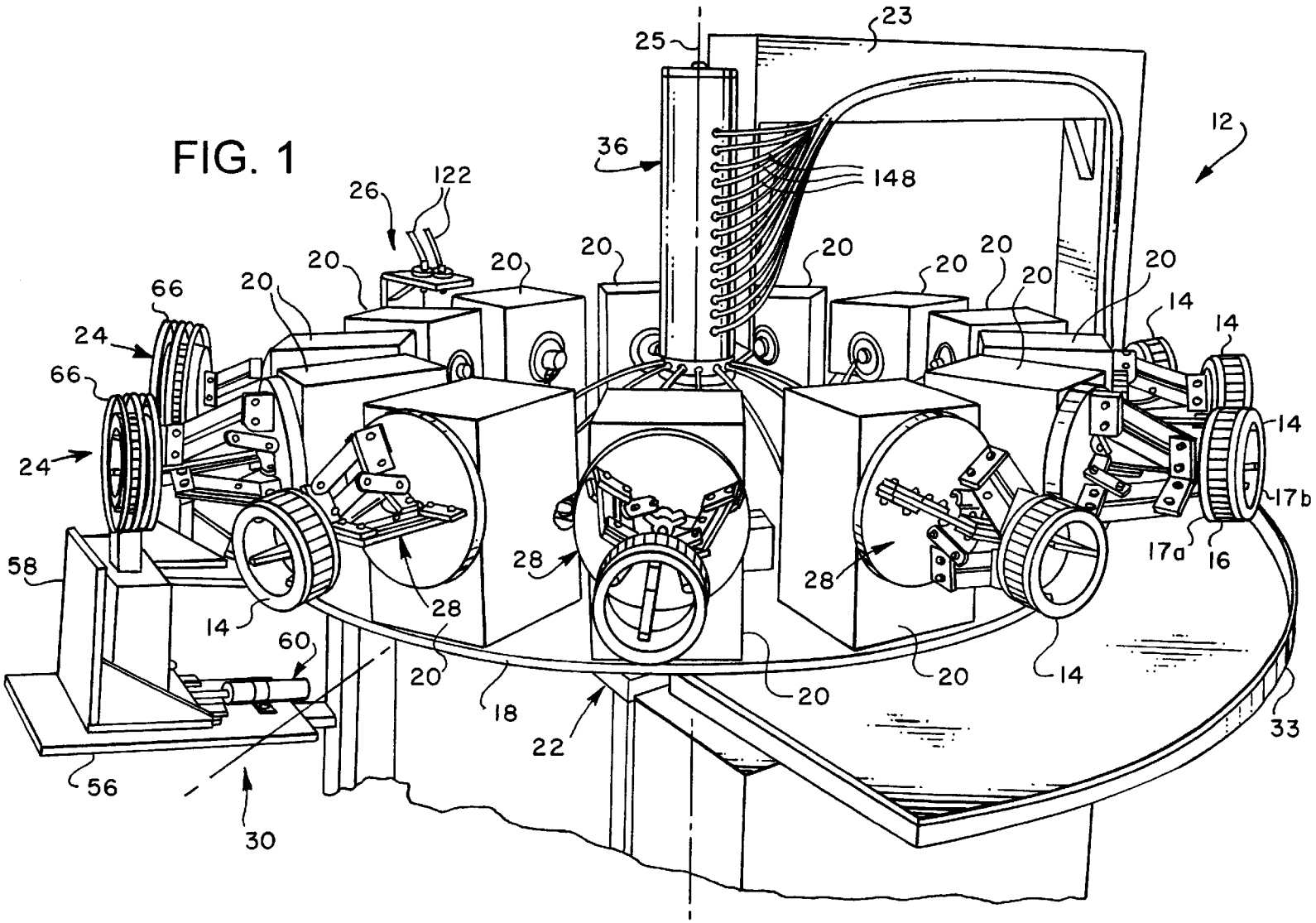
FIG. 1 is a perspective view of an apparatus in accordance with the invention for applying a hardenable liquid coating to a workpiece, such as the application of "varnish" to the electrical conductor windings of an electrical generator or motor rotor or stator member.

In the description which follows like parts are marked throughout the specification and drawing with the same reference numerals, respectively. The drawing figures are not necessarily to scale and certain elements may be shown in somewhat schematic or generalized form in the interest of clarity and conciseness.

Referring to FIG. 1, there is illustrated an apparatus in accordance with the present invention and generally designated by the numeral 12. The apparatus 12 is particularly adapted for performing a process on electrical components, such as electric motor or generator, rotor or stator members, for applying a curable liquid coating or "varnish" to the electrical conductor windings of such components. In particular, as illustrated, the apparatus 12 is adapted to apply a curable viscous liquid coating or varnish to the electrical windings of automotive alternator stator members shown mounted on the apparatus and indicated, respectively, by numeral 14. Alternator stator members such as the members 14 typically are characterized by electrical conductor windings 17*a* and 17*b* which extend on opposite sides of a circular ring shaped core portion 16, as indicated, for at least one of the workpieces or stator members 14, shown in FIG. 1.

The apparatus 12 is characterized by a generally cylindrical rotatable table member 18 which is adapted to support plural workpiece supporting structures arranged spaced apart about the circumference of the table 18 and each characterized by a gripper assembly support member or housing 20. As shown in FIG. 1, a total of thirteen support housings 20 are spaced about the circumference of the table 18, although greater or lesser numbers of such support structures may be provided. As further shown in FIG. 1, the table 18 is supported on a frame 22 for rotation in a generally clockwise direction, viewing FIG. 1, wherein each of the support housings 20 may be rotatably indexed to successive positions for heating of the workpieces 14 by adjacent induction heater units 24, respectively. The heater units 14 are each moveable radially with respect to an axis of rotation 25 of the table 18 toward and away from the axis to heat the workpieces 14, successively, as the table 18 is rotatably indexed. The workpieces or alternator stator members 14 are also successively rotatably indexed to a work station including an applicator assembly 26 at which a curable liquid coating, such as a styrene based "varnish", may be applied to the windings 17*a* and 17*b* while the workpieces 14 are rotated to distribute the coating. The applicator assembly 26 will be further described herein.

Referring further to FIG. 1, each of the workpiece support housings 20 is adapted to support a workpiece gripper assembly 28, respective ones of which are identified, by way of example, in FIG. 1. The gripper assemblies 28 are adapted to releasably grip the alternator stator workpieces 14 and to rotate the workpieces at a predetermined rate as they are moved seriatim to the stations at which they are heated by the heater units 24 and have a liquid coating applied thereto at the applicator assembly 26. The apparatus 12 is arranged to have a station or position 30 indicated by the radial line at which a workpiece 14 may be removed from and mounted on a gripper assembly 28 as the support housings 20 are moved into position in alignment with the station 30. Accordingly, workpieces 14 are rotatably indexed also from the station for applicator assembly 26 through ten indexed positions between the assembly 26 and the station 30 during which the workpieces are rotated at a predetermined rate by the gripper assemblies 28 to allow uniform distribution and curing of the coating which has been applied at the work station. As shown in FIG. 1, a coating drip tray 33 is preferably provided for the apparatus 12 to catch any liquid coating which may drip off the workpieces 14 as they are indexed from the station for applicator assembly 26 to station 30.

As further shown in FIG. 1, the frame 22 includes a somewhat inverted U-shaped member 23 which is adapted to support a pressure fluid distributor or rotary coupling 36 for distributing pressure fluid, such as compressed air, to each of the support housings 20 for actuating respective actuators associated with the gripper assemblies 28.

Figure 2:
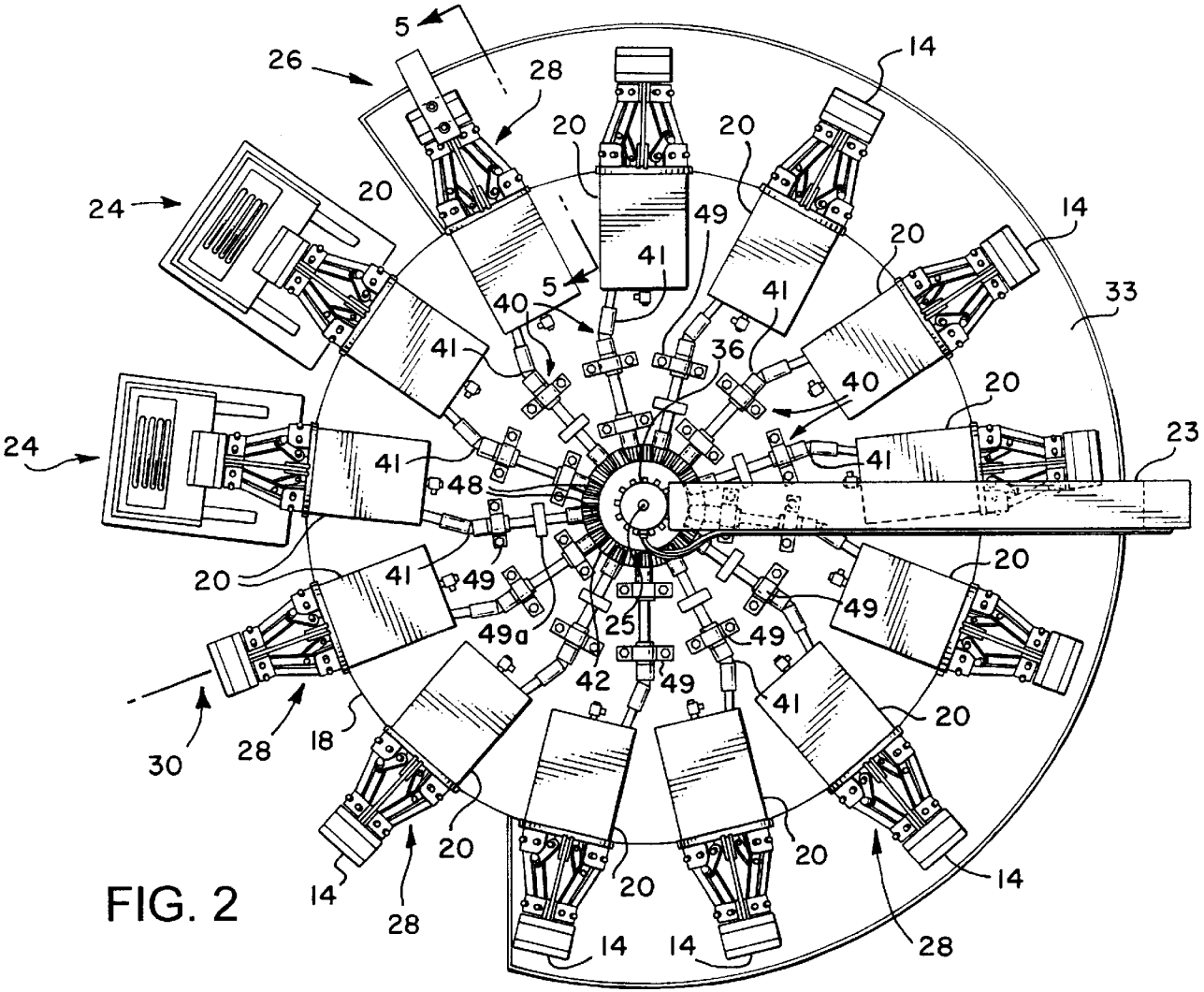
FIG. 2 is a plan view of the apparatus shown in FIG. 1.

Referring primarily to FIG. 2, each of the workpiece support housings 20 for supporting the gripper assemblies 28 is operably connected with an articulated rotatable drive shaft assembly 40, representative ones of which are identified in FIG. 2. Each of the drive shaft assemblies 40 is drivenly connected to a rotatable ring gear 42 supported on the apparatus frame 22 and drivenly connected to a variable speed electric motor 44, see FIG. 3, by way of a suitable drive shaft 46. Drive shaft 46 extends through a suitable passage 25*b* coaxial with axis 25. The bevel type ring gear 42 is drivingly connected to respective bevel gears 48 connected to each drive shaft assembly 40, as shown also in FIG. 3. The drive shaft assemblies 40 are also each provided with so-called universal or constant velocity joints 41 of conventional design for articulation of the drive shaft assemblies in the manner illustrated and to be described further herein. The drive shaft assemblies 40 are also suitably mounted in spaced apart bearing blocks 49 and 49*a*, respectively, FIG. 2, supported on the table 18. Certain ones of the support housings 20 and gripper assemblies 28 are omitted in FIG. 3 to illustrate other features of the apparatus 12.

Figure 3:
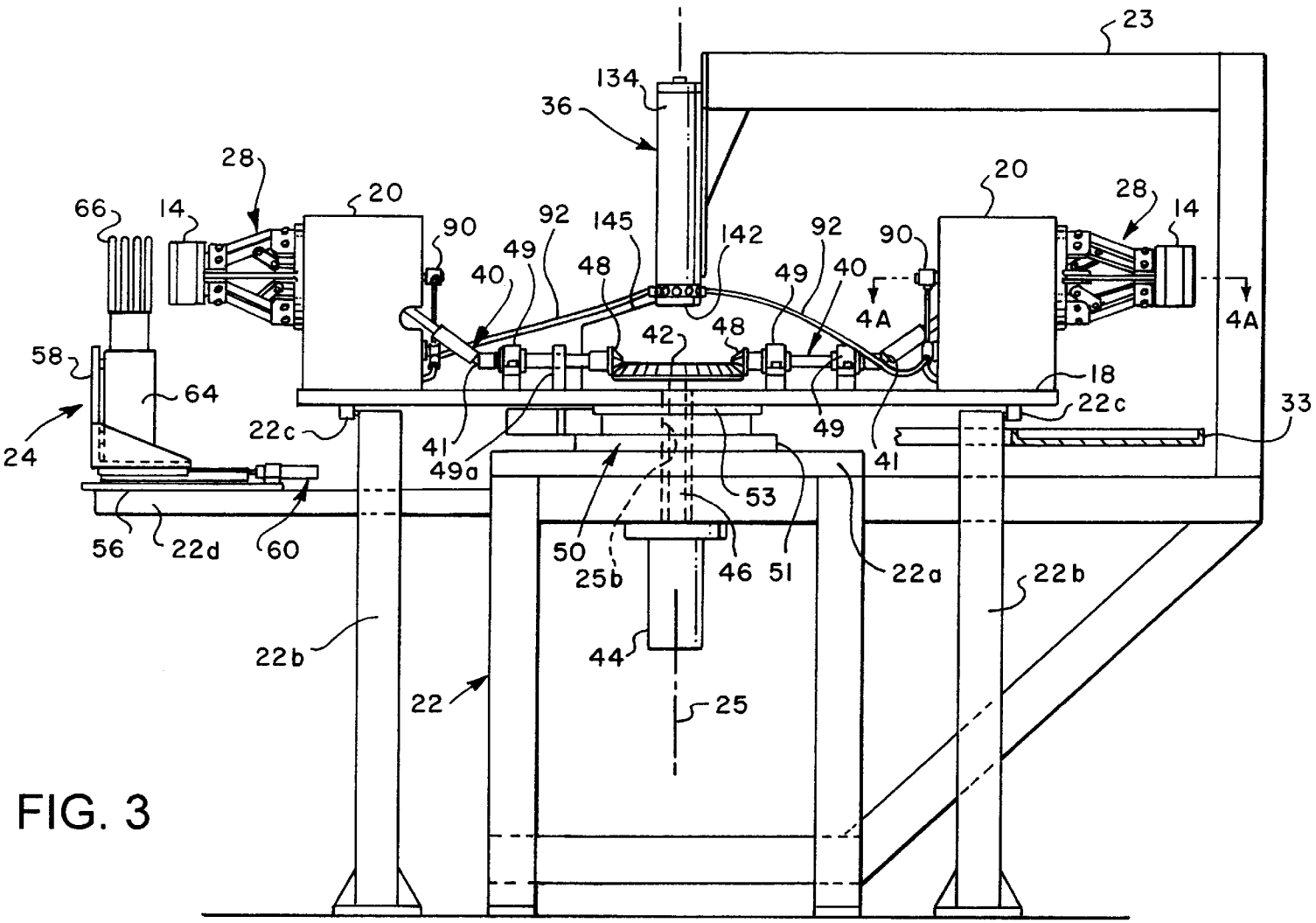
FIG. 3 is a side elevation of the apparatus shown in FIGS. 1 and 2 showing certain features of the workpiece rotary drive mechanism and support structure for the rotary table.

Referring further to FIG. 3, the frame 22 is adapted to support the table 18 by way of a rotary index type actuator generally designated by the numeral 50. The actuator 50 may be of a type commercially available such as a model 13-F75-270-F11 actuator manufactured by Ferguson Indexer of St. Louis, Mo. The actuator 50 includes a base member 51 mounted on a frame member 22*a* of the frame 20 and supporting a flanged connector member 53 which is connected to the table 18. Actuator 50 is adapted to rotate the table 18 incrementally about axis 25 when energized by a suitable control system to be explained in further detail herein. The table 18 is also preferably supported at spaced apart points adjacent to periphery by spaced apart upstanding frame stanchions 22*b* which are adapted to support table support rollers 22*c,* as shown in FIG. 3, engageable with the radially outer portions of the table 18. As also shown by way of example in FIG. 3, the heater units 24 may each be supported on a frame member 22*d.*

Figure 3A:
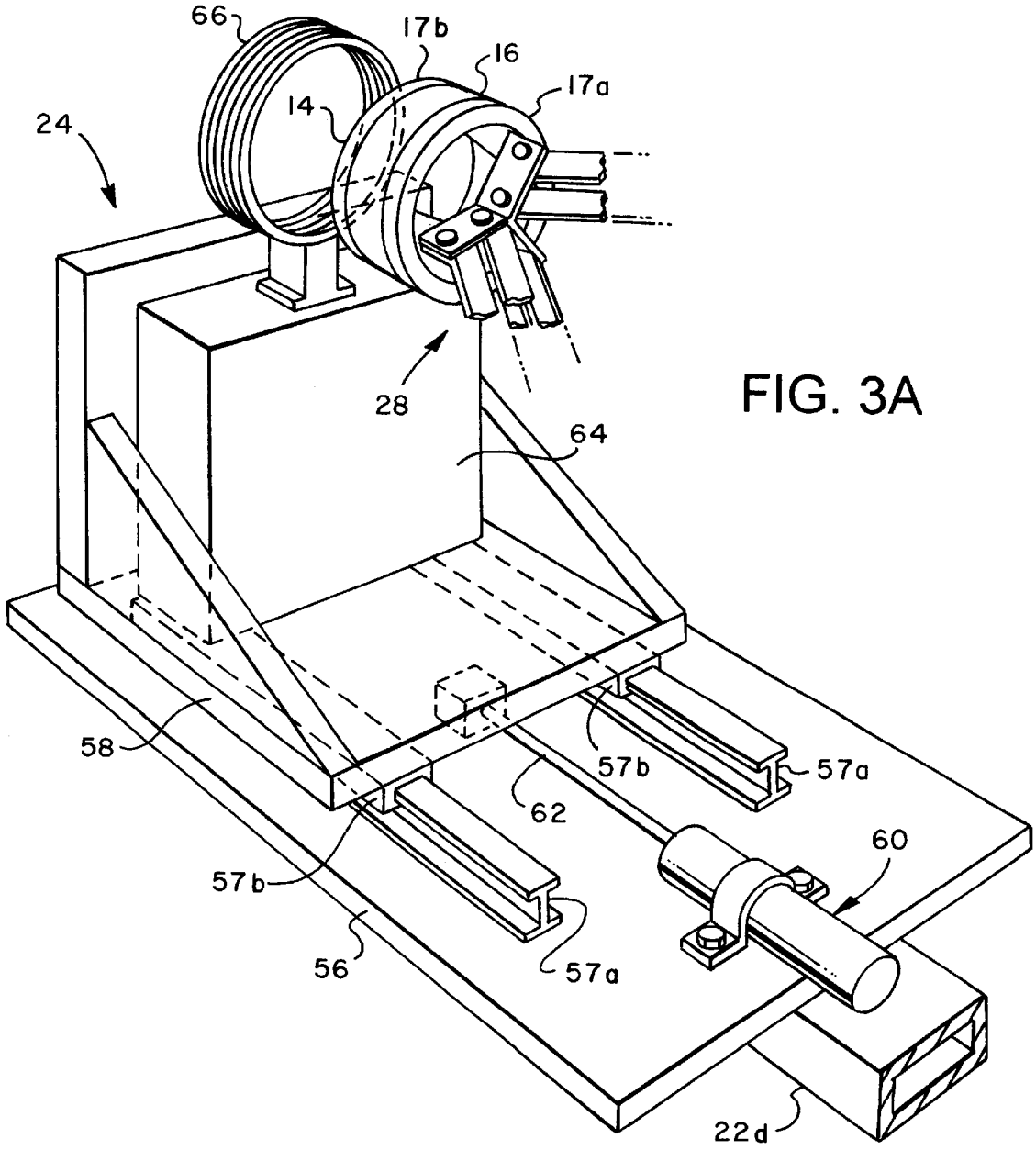
FIG. 3A is a perspective view of one of the retractable heater assemblies for treating the workpieces as they are rotatably indexed by the apparatus of the invention.

Referring briefly to FIG. 3A, each induction heater unit 24 includes a support base 56 suitably supported on a frame member 22*d* or otherwise supported adjacent to the table 18 to be proper position for heating a workpiece 14. The generally rectangular base 56 supports spaced apart linear bearing rails 57*a* which are adapted to support a linearly slideable frame 58, including conventional linear bearings 57*b,* and which is moveable between a retracted position, as shown in FIG. 3A, to a working position by a linearly extensible pneumatic cylinder type actuator 60. Actuator 60 is mounted on the base 56 and is connected to the frame 58 through a piston rod 62. The frame 58 is adapted to support a housing 64 for a commercially available induction heater, such as a five kilowatt heater manufactured by Miller Electric Manufacturing Company of Appleton, Wis. The heater units 24 each include an induction heating coil 66 which is of a diameter sufficient to allow for movement of the coil 66 to surround the workpiece 14 to suitably heat the electrical windings 17*a* and 17*b* thereof in a manner known to those skilled in the art. Accordingly, when a workpiece, such as the alternator stator workpiece 14, is indexed to a position to be heated by one of the heater units 24, actuator 60 is energized to move frame 58 linearly to a position wherein the coil 66 surrounds the workpiece 14 and suitably heats the windings 17*a* and 17*b.* Prior to rotably indexing the table 18 to move the workpiece in question to the next station the actuator 60 is suitably energized to extend its piston rods 62 and retract the frame 58 to a position wherein the coil 66 is displaced from engagement with the workpiece and it may be rotatably indexed to the next working position. The respective heater units 24 are extended and retracted with respect to their working positions, preferably simultaneously.

Figure 4:
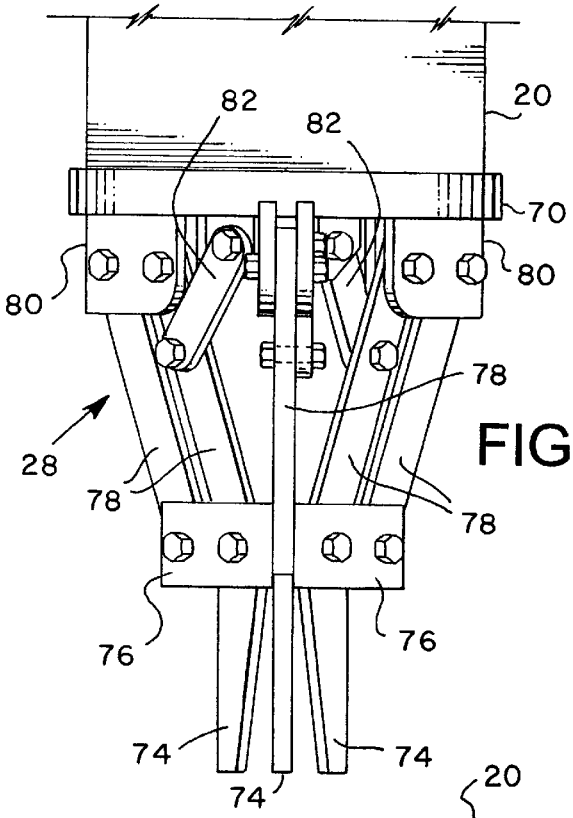
FIG. 4 is a detail plan view of one of the retractable workpiece gripper assemblies.
Figure 4A:
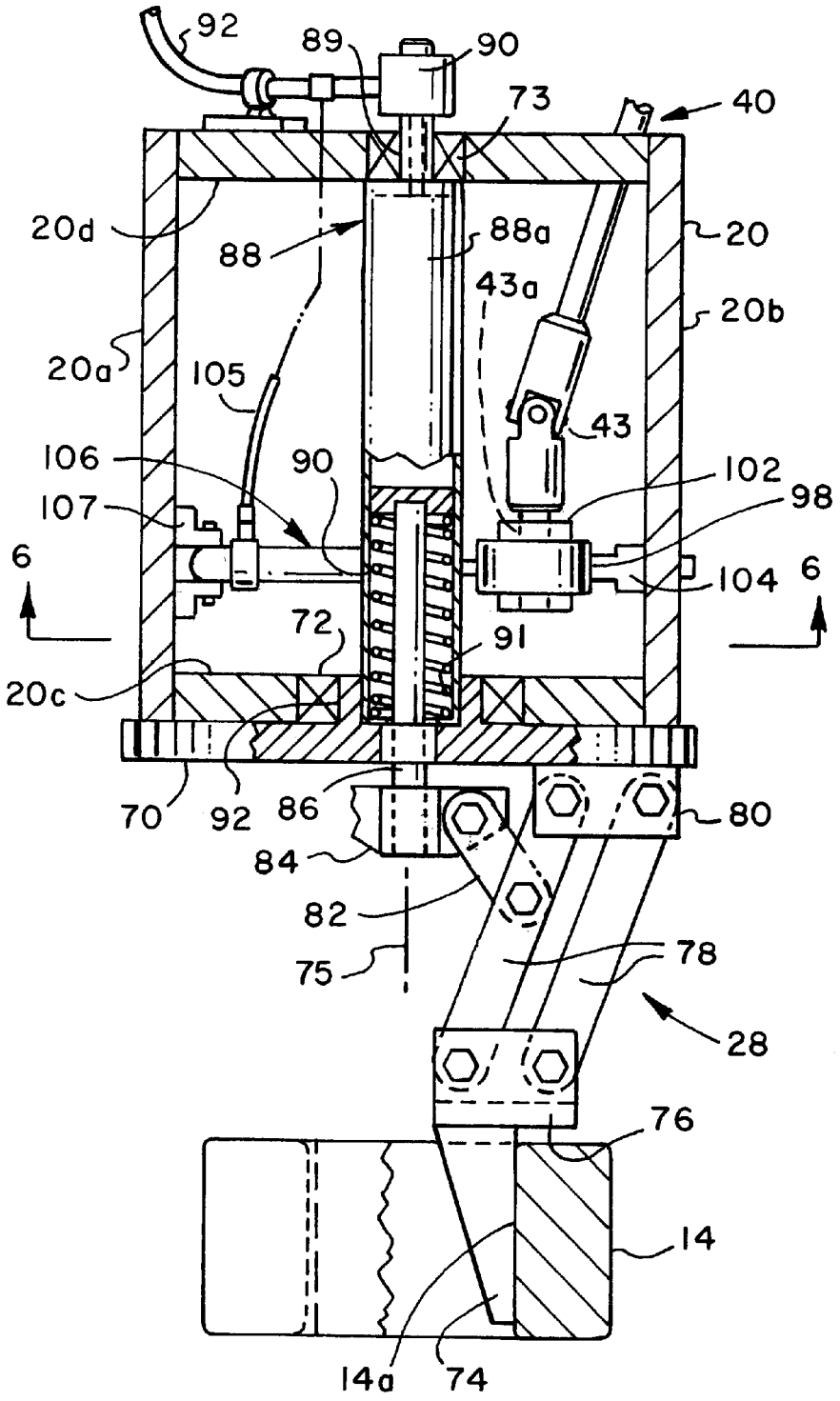
FIG. 4A is a section view taken along line 4A—4A of FIG. 3 showing one of the gripper assembly support housings and details of the gripper actuator and rotary drive arrangement.

Referring now to FIGS. 4 and 4A, each gripper assembly 28 includes a generally circular support plate 70 mounted on a support member or housing 20. Each support housing 20 is preferably characterized by opposed side walls 20*a* and 20*b,* FIG. 4A, and end walls 20*c* and 20*d.* The gripper assembly support plate 70 is mounted in a suitable bearing 72 supported on the end wall 20*c* for rotation with respect to the support housing 20. As shown in FIG. 4, the gripper assembly 28 includes three circumferentially spaced workpiece gripper fingers 74 which are supported for radial extension and retraction to grip and release a workpiece 14. The gripper fingers 74 are preferably circumferentially spaced equal distant from each other at 120° intervals with respect to an axis of rotation 75, FIG. 4A. Each gripper finger 74 includes a channel shaped base member 76 which is pivotally connected to a parallelogram linkage including two spaced apart and parallel links 78. Links 78 are pivotally mounted on the support plate 70 by channel shaped brackets 80.

As further shown in FIG. 4A, in particular, actuator linkage comprising a link 82 is connected to the inboard link 78 of each pair of links 78 at one end and link 82 is pivotally connected to a head member 84 at its opposite end. The head member 84 is disposed on the distal end of a piston rod 86, FIG. 4A, of a pressure fluid operated linear cylinder type actuator 88 which is operated by pressure fluid to extend the piston rod 86 to move the gripper fingers 74 into forcible engagement with bore wall 14*a* of workpiece 14. The actuator 88 includes a return spring 90 for biasing the head 84 to the retracted position to move the gripper fingers 74 radially inwardly toward each other and away from gripping engagement with the workpiece 14. Accordingly, in response to conducting pressure fluid to the cylinder actuator 88, the piston rod 86 is extended to force the gripper linkages to move the gripper fingers 74 into forcible engagement with a workpiece 14 and, upon venting pressure fluid from the cylinder actuator 88, the return spring 90 will retract the piston rod 86 and the head 84 to radially retract the gripper fingers 74 away from gripping engagement with a workpiece, such as the alternator stator 14.

As further shown in FIG. 4A, the actuator 88 is mounted in a bore 91 formed in a hub portion 92 of the support plate 70 and actuator 88 is mounted at its opposite in a suitable bearing 73 disposed in the housing end wall 20*d,* as illustrated. The actuator 88 includes a tubular trunnion 89 extending from the end thereof opposite the piston rod 86 and which is supported in the bearing 73 and is operably connected to a rotary fluid coupling 90. Coupling 90 is operable to provide for conducting pressure fluid to the cyclinder actuator 88 by way of a conduit 92 while allowing the actuator to rotate together with the support plate 70, the gripper assembly 28 and a workpiece 14. The rotary coupling 90 may be of a type commercially available, such as a model 2000 series manufactured by Rotary Systems, Inc. of Anoka, Minn. Pressure fluid is conducted through the conduit 92 between the actuator 88 and a suitable control valve, not shown, and through the coupling 90 to provide for operation of the actuator 88 and the gripper assembly 28.

Figure 6:
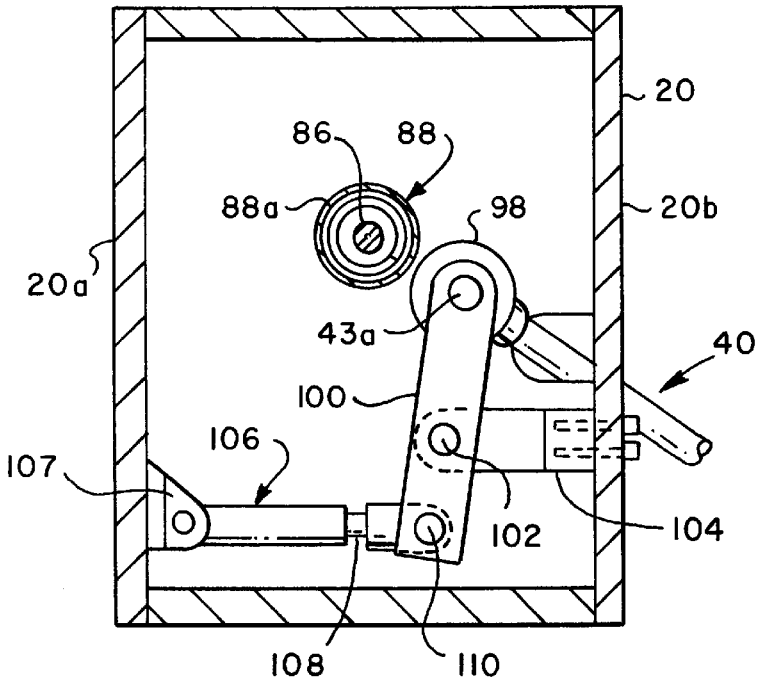
FIG. 6 is a section view taken along the line 6—6 of FIG. 4A showing details of the gripper friction wheel drive and actuator.

Referring further to FIGS. 4A and 6, each actuator 88 together with its support plate 70 and a gripper assembly 28 is operable to be rotated about axis 75 by a drive mechanism comprising a drive shaft assembly 40 including a second universal or constant velocity joint 43, see FIG. 4A, which is drivingly coupled to a friction wheel 98, FIGS. 4A and 6. Friction wheel 98 is rotatably supported on a yoke 100 which is mounted for pivotal movement about a pivot 102 supported on a suitable bracket 104 mounted on housing side wall 20*b.* A stub shaft 43*a* is coupled to the universal joint 43, is also drivingly coupled to the friction wheel 98 and is supported for rotation in the yoke 100.

As shown also in FIGS. 4A and 6, the yoke 100 is adapted for pivotal movement about pivot 102 by a pressure fluid cylinder actuator 106 whose piston rod 108 is pivotally coupled to the yoke 100 at a pivot 110, FIG. 6. The actuator 106 is also pressure fluid operated to extend a piston rod 108 to pivot yoke 100 in a counterclockwise direction, viewing FIG. 6, to engage friction wheel 98 with the outer cylindrical surface of cylinder member 88*a* of the cylinder actuator 88 to effect rotation of the actuator, including the support plate 70 and the gripper assembly 28, with respect to the support housing 20. In response to venting pressure fluid from actuator 106, piston rod 108 is spring biased to retract to the position shown in FIGS. 4A and 6 to disengage the friction wheel 98 from the cylinder member 88*a* to thereby cease driving rotation of the cylinder. A pressure fluid conduit 105, FIG. 4A is operably connected to the actuator 106 and to conduit 92 to simultaneously apply pressure fluid to the actuators 88 and 106 so that when the gripper assembly 28 is actuated to forcibly grip a workpiece 14 the workpiece is rotated by the drive mechanism comprising drive shaft 40, friction wheel 98 and actuator 88. When pressure fluid is vented from the actuators 88 and 106 the gripper assembly 28 is retracted away from forcible engagement with the workpiece 14 and actuator 106 effects disengagement of the friction drive including the friction wheel 98 from the actuator cylinder 88*a*. As shown in FIG. 6, the actuator 106 is pivotally mounted at its end opposite the end including the piston rod 108 by a suitable clevis type support member 107 supported on housing wall 20*a*.

Each gripper assembly 28 is independently controlled to rotate and to engage and release gripping engagement with a workpiece 14. Accordingly, when pressure fluid is supplied through each conduit 92 to each actuator 88 by way of a coupling 90 and to an actuator 106, simultaneously, the gripper assembly 28 is operated to forcibly engage a workpiece 14, such as a generator or alternator stator member, as shown, and to also begin rotating the workpiece about axis 75 at each support housing 20. However, when a gripper assembly 28 reaches the workpiece removal and loading station 30 it is desirable to de-energize the gripper assembly to release forcible engagement with the workpiece and to cease rotating the workpiece.

As the table 18 is rotatably indexed about axis 25, each of the gripper assemblies 28 is maintained in forcible gripping engagement with its workpiece and is rotated at a predetermined speed, except the gripper assembly 28 which is positioned at the load/unload station 30 is controlled to cease rotation of the workpiece and release forcible engagement therewith. Accordingly, each gripper assembly 28 must be separately controlled so that it can be actuated to grip and release its workpiece at station 30. As rotary table 18 is indexed to place a gripper assembly 28 at station 30 pressure fluid is vented from the conduit 92 associated with that gripper assembly to cease rotation of the gripper assembly and to allow relaxing of forcible engagement of the fingers 74 with the workpiece. While the rotary table 18 is stationary an operator may remove one workpiece, which is now finished with respect to its work process, and a new workpiece 14 may be mounted on the gripper assembly 28 whereupon the gripper assembly which has exchanged workpieces may then be re-energized to forcibly grip the new workpiece and begin rotation of same.

Control of the apparatus 12 may be carried out in such a way that the table 18 is indexed to place a gripper assembly 28 and its support housing 20 at station 30 and for a predetermined period of time the gripper assembly is relaxed and not rotated to permit removal of one workpiece and replacement with a new workpiece. When this predetermined time period has elapsed the gripper assembly 28 is energized and rotation begins and the table 18 is then indexed about axis 25 one gripper assembly position to allow the next gripper assembly 28 and its associated finished workpiece to be placed at the load/unload station 30.

Figure 5:
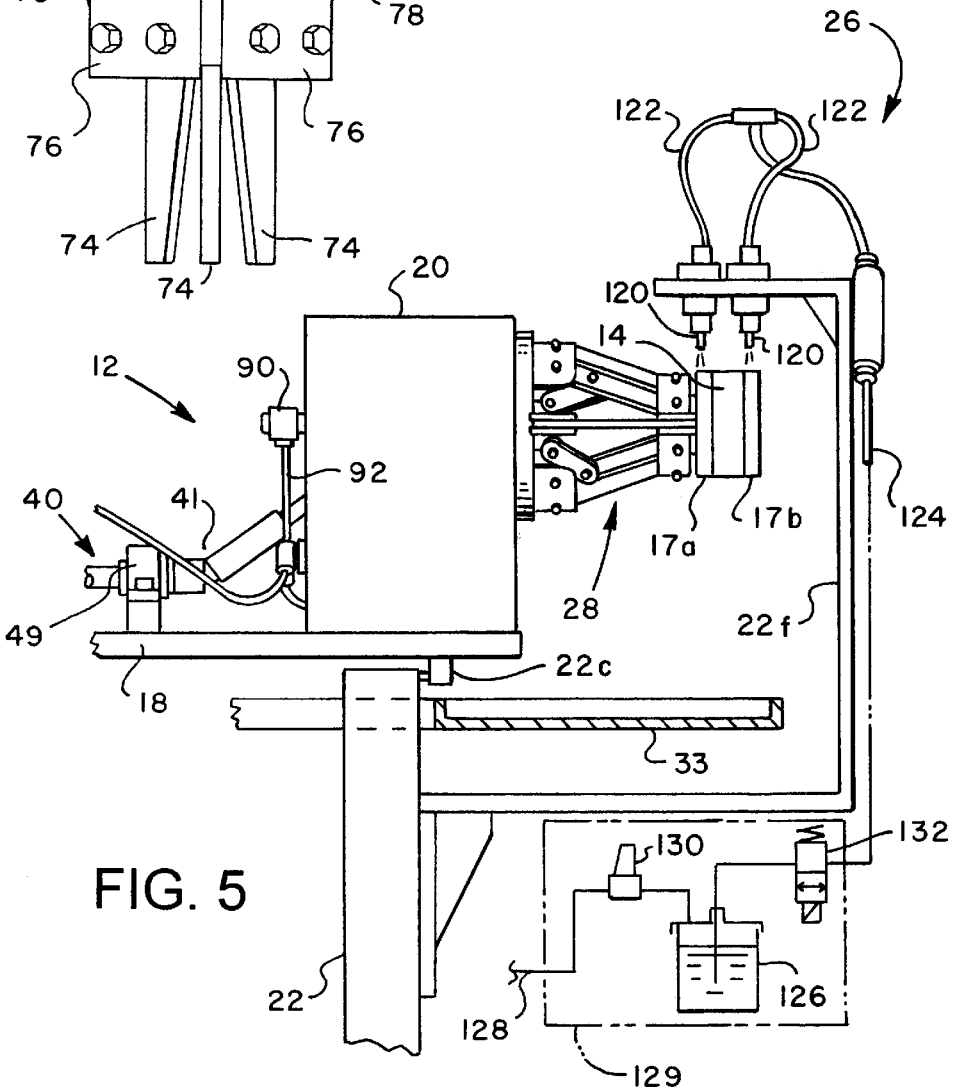
FIG. 5 is a view taken generally along line 5—5 of FIG. 2 showing details of the coating applicator station for the apparatus.

As a gripper assembly 28 and its associated workpiece is indexed from the load station 30 through the stations at which the heater units 24 are disposed the workpiece 14 is then indexed to the applicator station including the applicator assembly 26. As shown in FIG. 5, the applicator assembly 26 includes a frame member 22*f* on which are suitably mounted spaced apart viscous liquid applicator nozzles 120. Nozzles 120 are connected via respective conduits 122 to a common conduit 124 which, in turn, is connected to a source of liquid coating material indicated at 126. The source 126 may be a closed pressure vessel which is pressurized at a suitable working pressure by a source of regulated pressure air delivered to the vessel via a conduit 128 and regulator 130. A suitable shutoff valve 132 may be interposed in conduit 124 and remotely controlled in timed relation to indexing of the table 18 to conduct coating liquid, such as the aforementioned varnish, to the nozzles 120 for application to the windings 17*a* and 17*b* of the stator workpiece 14. As shown in FIG. 5, the nozzles 120 are disposed directly above the workpiece 14 when it is indexed to the position shown, at which time, while the workpiece is rotating, varnish may be applied to the conductor windings through the nozzles 120. Uniform distribution of fluid is assured by rotation of the workpiece 14 by the gripper assembly 28. The pressure vessel source 126 may comprise a commercially available varnish or lacquer applicator unit 129, as indicated in FIG. 5.

The speed of rotation of the workpiece 14 is adjusted for the size (diameter) of the workpiece and the viscosity of the fluid so that penetration of liquid between conductor windings 17*a* and 17*b*, for example, is achieved without puddling of the liquid. Moreover, the speed of rotation of the gripper assemblies 28 and the workpieces is controlled to avoid throwing off the "varnish" due to centrifugal forces. Control of valve 132 to shutoff flow of fluid to the nozzles 120 is desirable when the table 18 is being indexed to place a new workpiece 14 under the nozzles 120 in the position shown in FIG. 5. Moreover, by utilizing the application nozzles 120 to apply a curable liquid coating or "varnish" to electrical components, such as motor and generator rotors and/or stator members, with such a member being rotated uniformly while the liquid is applied, a more even distributions of such coatings is provided with the apparatus of the present invention.

Figure 7:
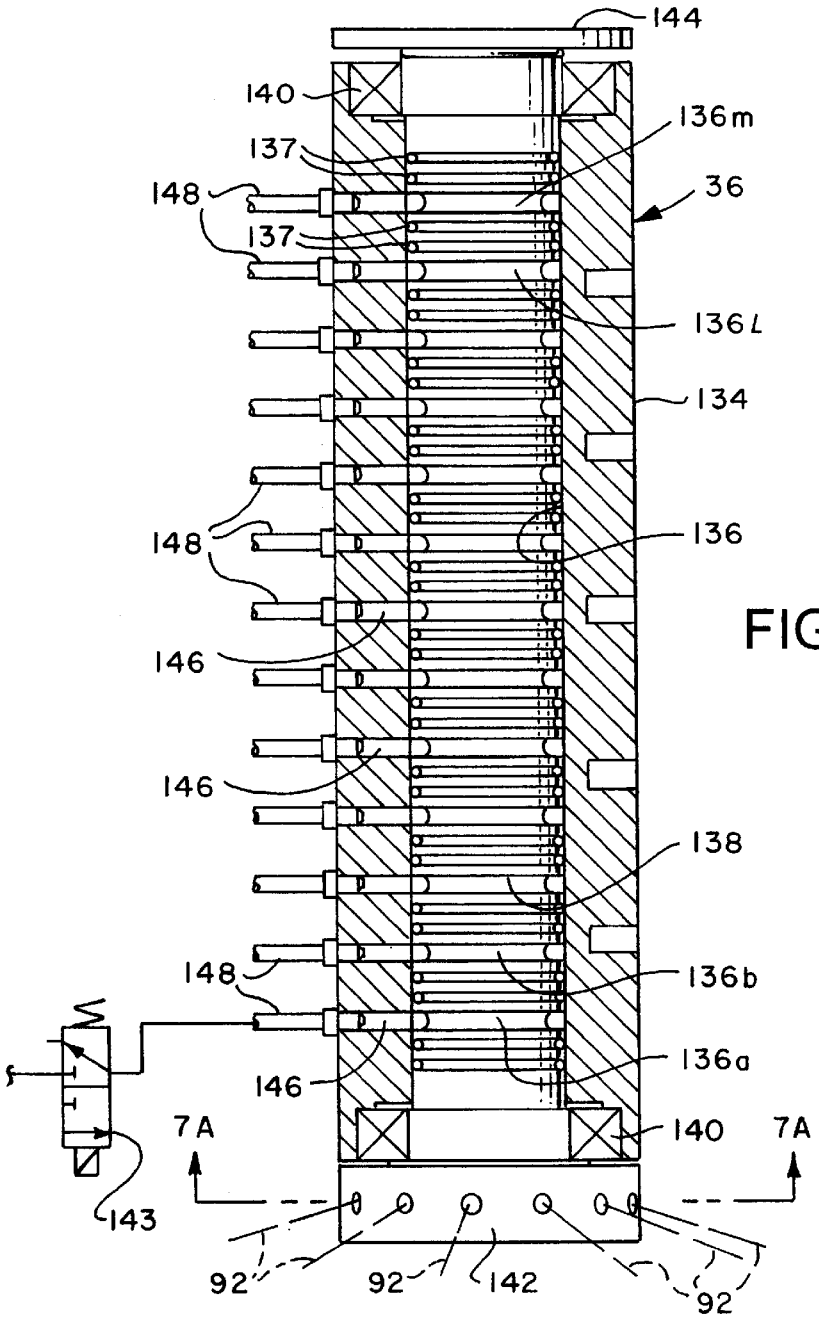
FIG. 7 is a longitudinal central section view through the gripper and friction drive actuator pressure air distributor coupling for the respective workpiece support and gripper assemblies.
Figure 7A:
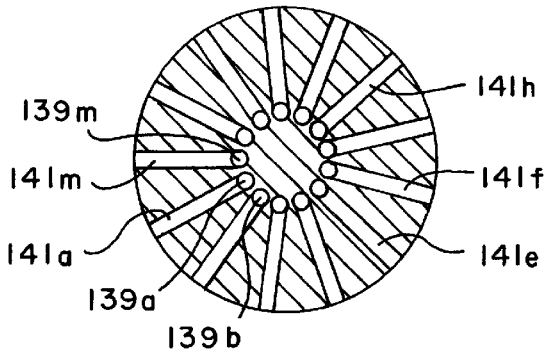
FIG. 7A is a detail section view taken along the line 7A—7A of FIG. 7.

Referring now to FIGS. 7 and 7A, the pressure fluid distributor or rotary coupling 36 is operable to distribute pressure fluid, such as compressed air, to respective ones of the actuators 88 and 106 of the gripper assemblies 28 for energizing the actuators and, conversely, for venting pressure fluid from the actuators. The fluid distributor 36 includes an elongated generally cylindrical barrel member 134, FIG. 7, supported on frame member 23 and having a central bore 136 for receiving an elongated fluid distributor spool 138 rotatably supported within the bore on spaced apart bearings 140. The spool 138 includes an enlarged diameter head portion 142 formed at one end and a removable cap 144 suitably connected to the spool at the opposite end for retaining the spool in the bore 136 for rotation relative to the barrel 134.

As shown in FIG. 7, the barrel 134 includes a plurality of spaced-apart pressure fluid-conducting passages 146, one for each gripper assembly 28 and its associated actuators. Each of the passages 146 is connected to a fluid supply and vent conduit 148, as shown, and the passages 146 open into the bore 136 for communication with respective spaced-apart grooves 136*a*, 136*b* and so on through 136*m*, there being one passage 146, one conduit 148 and one groove for each of the gripper assemblies 28. Each passage 136*a*, 136*b* and so on through 136*m* is isolated from an adjacent passage by suitable o-ring seals 137 disposed in circumferential grooves formed in the spool 138.

Figure 8:
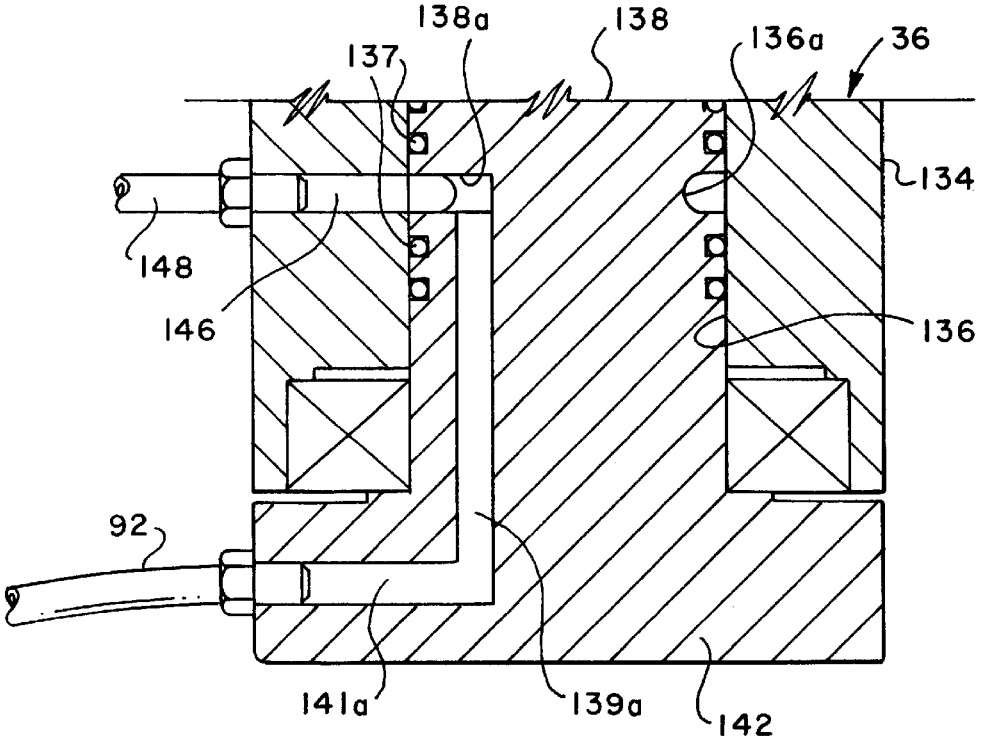
FIG. 8 is a detail section view showing a typical arrangement of the passageways for the distributor coupling shown in FIGS. 7 and 7A.

As shown by way of example in FIG. 8, the lowermost annular groove 136*a* formed in the spool 138 includes a radially inwardly extending passage 138*a* which is in communication with an axially-extending passage 139*a* and a radially-extending passage 141*a* formed in the head 142 and which passage is in communication with a conduit 92. Accordingly, pressure fluid may be conducted from one of conduits 142 and an associated passage 146, as indicated in FIG. 8, to a specific gripper assembly 28 and its actuators so that each gripper assembly may be independently controlled.

As shown in FIG. 7A, axially-extending passages 139*a* through 139*m* are provided in the spool member 138 and communicate with corresponding passages 141*a* through 141*m* which are radially-extending and circumferentially-spaced apart, as shown, and are each connected to a conduit 92 leading to a gripper assembly 28. Each groove 136*a* through 136*m* is also provided with a short radially-inwardly extending passage corresponding to the passage 138*a* for conducting pressure fluid between respective ones of the conduits 148 and an associated conduit 92. Separate solenoid operated remote controlled valves 43, one shown by way of example in FIG. 7, are connected to each conduit 148 and a suitable control circuit for supplying pressure air to each gripper assembly via the distributor or coupling 36. In this way, each of the gripper assemblies 28 may be independently-controlled to supply and vent pressure fluid with respect to its actuators 88 and 106 when the gripper assembly reaches the load/unload station 30. As shown in FIG. 3, the spool 136 may be forced to rotate with the table 18 through a connecting link 145 which interconnects the head 142 with the table 18 to relieve any strain on the conduits 92 as the table 18 rotates relative to the barrel 134.

Figures 9, 9A:
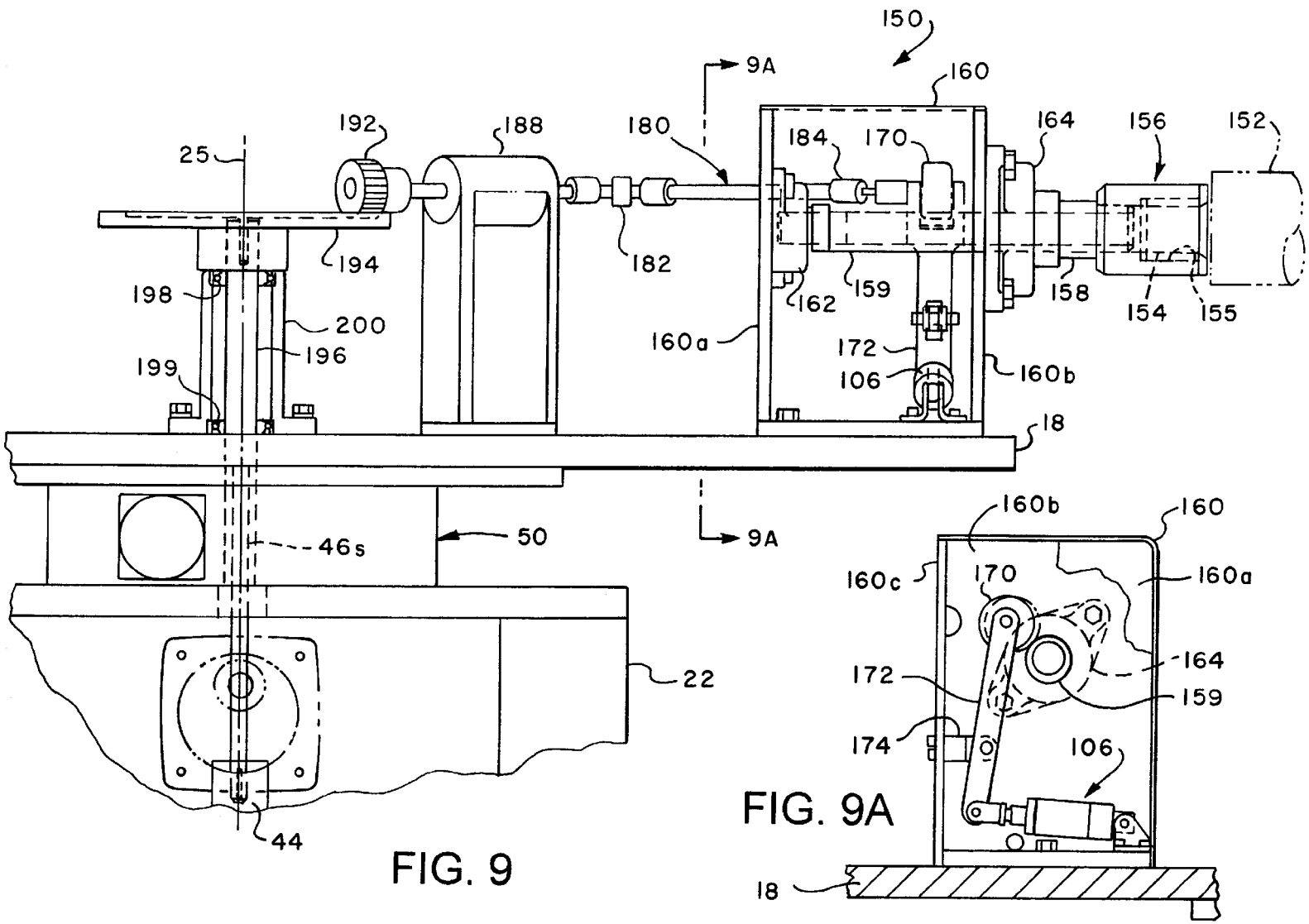
FIG. 9 is a partial side elevation of an alternate embodiment of a drive mechanism and workpiece support assembly in accordance with the invention.
FIG. 9A is a view taken generally from the line 9A—9A of FIG. 9 with a housing endwall broken away.

Referring now to FIGS. 9 and 9*a,* an alternate embodiment of an apparatus in accordance with the invention is illustrated and generally designated by the numeral 150. The apparatus 150 is similar in many respects to the apparatus 12 but is adapted to support for rotation thereon respective workpieces in the form of rotor members 152, for example, each having a stub shaft portion 154 for disposition within a bore 155 formed in a generally cylindrical rotor support head 156. Each rotor support head 156 is mounted on an elongated shaft 158 and supported on a modified support housing 160. Support housings 160, one shown only, are supported on rotary table 18 at each of plural stations in place of the support housings 20. Only one station or support housing 160 is shown in FIG. 9 in the interest of clarity and conciseness.

Support housing 160 includes opposed end walls 160*a* and 160*b* which support bearing assemblies 162 and 164, respectively, for supporting shaft 158 of head 156. Shaft 158 includes a reduced diameter part 159 extending between the bearing assemblies 162 and 164 and is engageable by a friction wheel 170 mounted on a yoke 172, see FIG. 9*a* also, which is supported for pivotal movement on the housing 160 by a clevis member 174 mounted on a housing side wall 160*c*. A pressure fluid cylinder actuator 106 is operably engaged with the yoke 172 to move the friction wheel 170 into and out of driving engagement with the shaft part 159 for rotating the head 156 and a workpiece 152 supported thereby.

Friction wheel 170 is drivenly connected to a drive shaft assembly 180 including one or more universal joints 182, 184 interposed therein. Drive shaft assembly 180 is supported in a suitable bearing assembly 188 mounted on table 18. The end of drive shaft assembly 180 opposite the friction wheel 170 includes a pinion 192 mounted thereon and engageable with a ring gear 194. Ring gear 194 is drivenly connected to a shaft 196 which is connected to motor 44 by way of a connecting shaft 46*s*. Shaft 196 is mounted in suitable bearings 198 and 199 disposed in an upstanding bearing housing 200 mounted on table 18, as illustrated. Accordingly, the apparatus 150 may include plural support heads 156 corresponding to the gripper assemblies 28 and each support head being supported on a support housing 160 and being adapted to be rotatably driven to rotate a workpiece 152 by the drive train comprising motor 44, shafting 46*s* and 196, ring gear 194, pinion 192 and a drive shaft assembly 180, as illustrated.

Figure 10A:
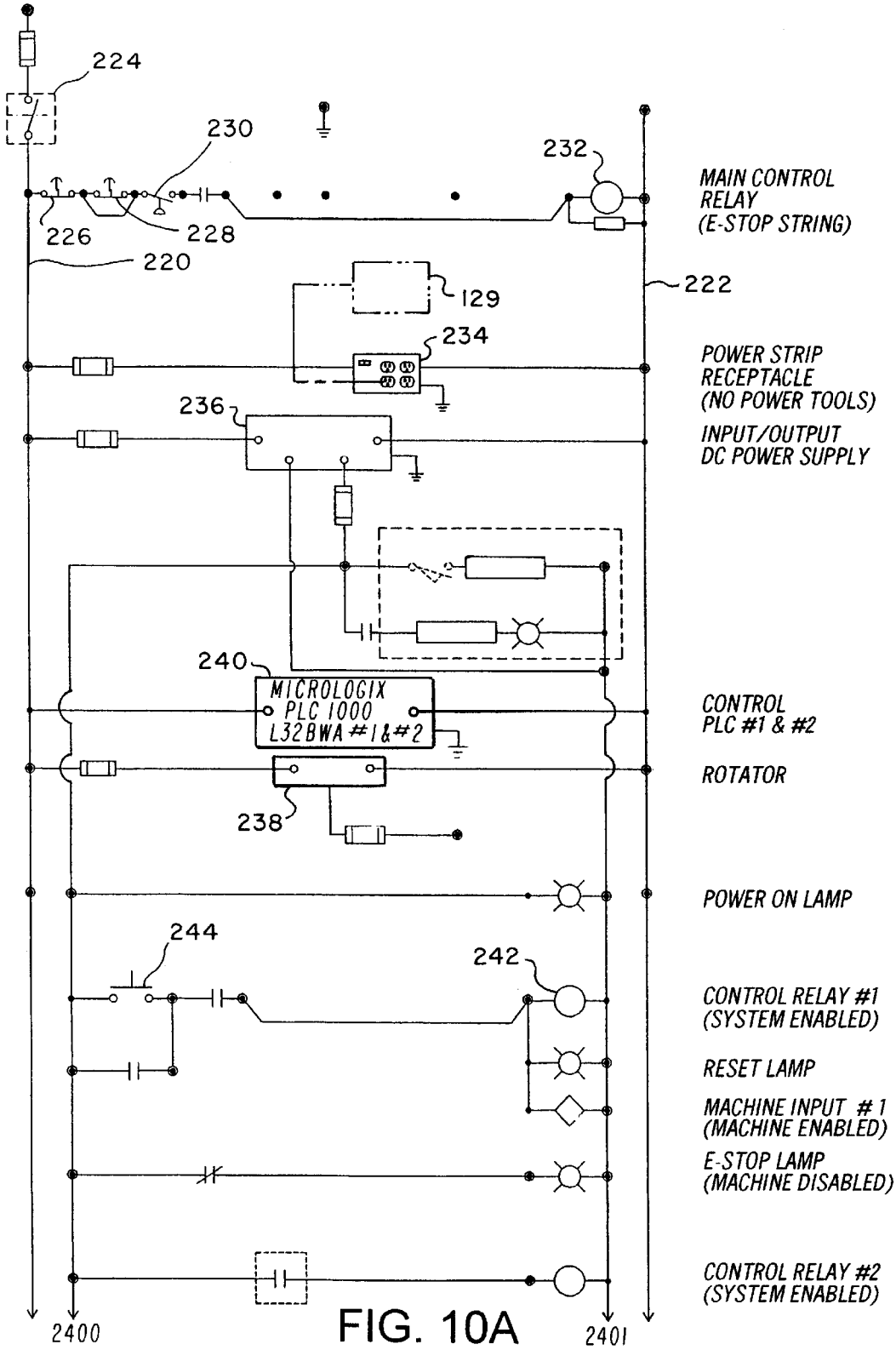
FIGS. 10A through 10C comprise a schematic diagram of a control system for the apparatus shown in FIGS. 1 through 8.
Figure 10B:
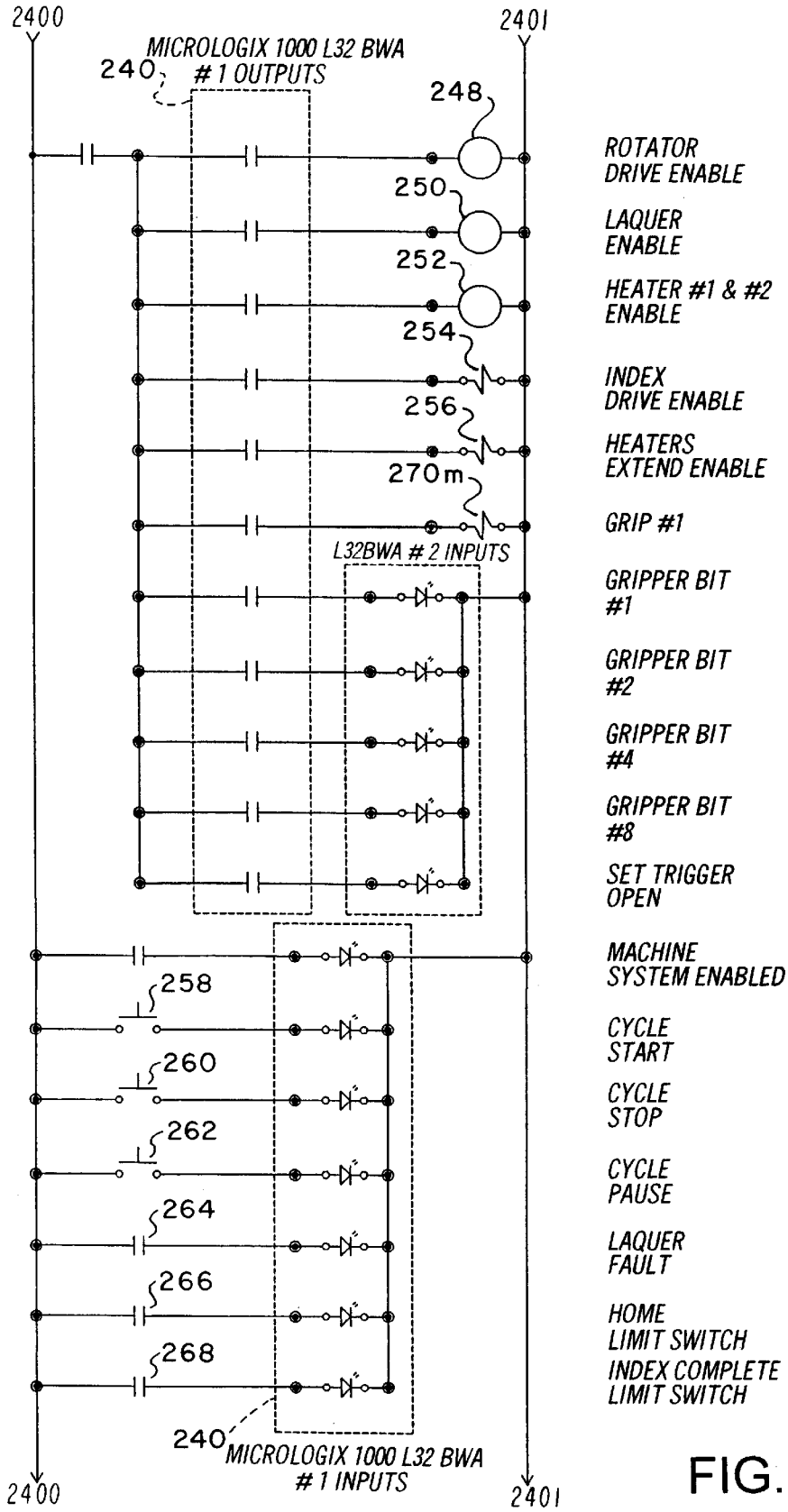
Figure 10C:
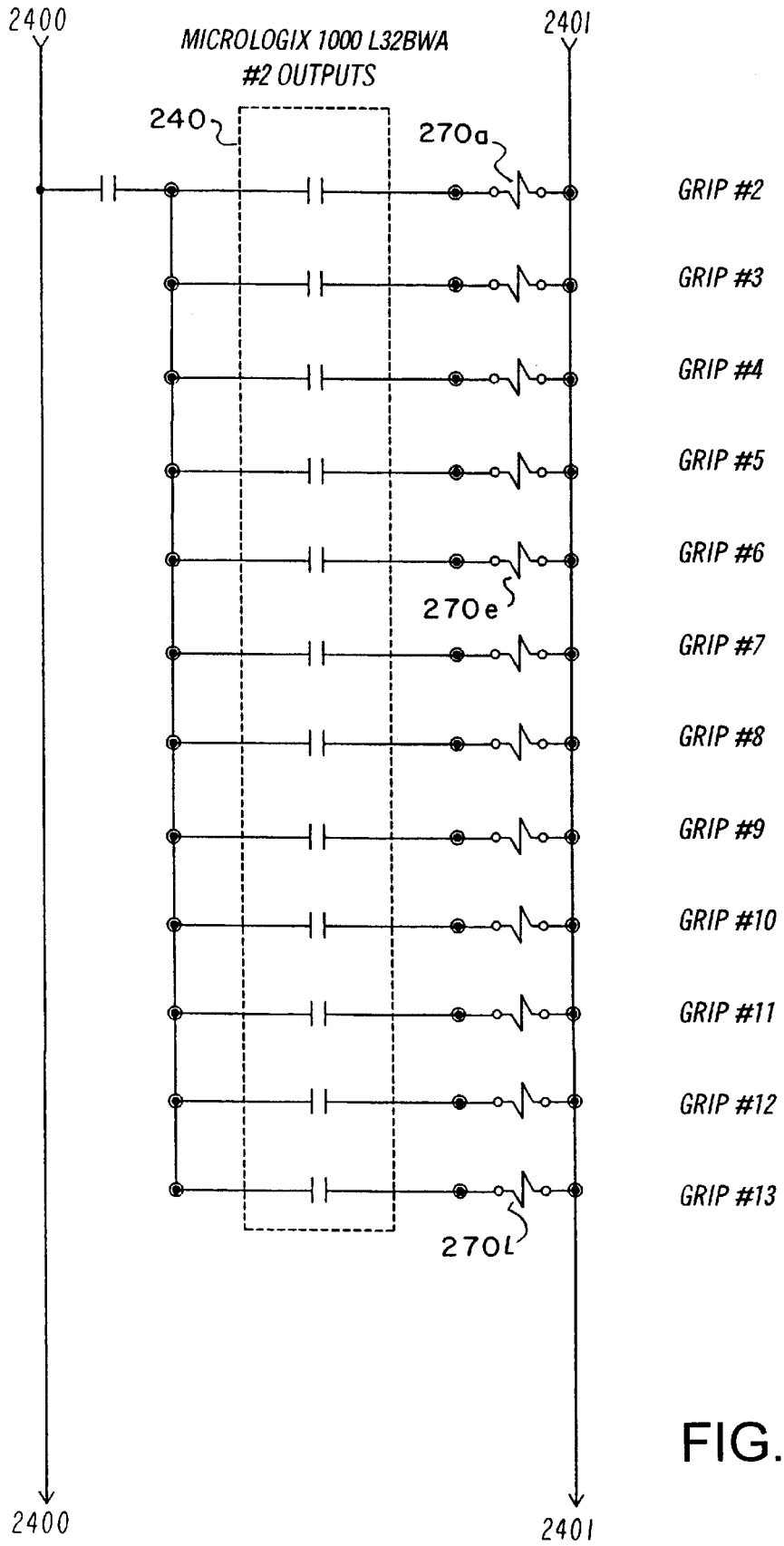

The operation of the apparatus 12 as well as a corresponding apparatus 150 is believed to be understandable to those of ordinary skill in the art based on the foregoing description. The apparatus 12 may be operated by a control system generally as shown in FIGS. 10A through 10C and which will be explained in further detail hereinbelow. The control system illustrated in FIGS. 10A through 10C may include a control circuit, such as a commercially-available programmable logic controller, for controlling the operation of the drive motor 44 to select the speed of rotation of the gripper assemblies 28 and the workpieces supported thereon. The aforementioned controller is also operable to provide signals, to effect operation of the actuator 50 to rotatively index the table 18 about axis 25 incrementally one support housing position at a time.

Still further, the aforementioned controller is operable upon rotatably indexing the table 18, to effect movement of the heater units 24 into their respective working positions and to control operation of the liquid applicator nozzles 120 to provide for ejecting curable liquid or "varnish" onto the windings 17*a* and 17*b* of a stator type workpiece 14 for a predetermined time during residence of a gripper assembly and workpiece at the station of the applicator assembly 26. Each time the table 18 is indexed, the gripper assembly 28 which is at station 30 is operated to vent pressure fluid from its associated actuators 88 and 106 to release gripping engagement with a workpiece 14 and to cease rotation of the gripper assembly so that a workpiece can be removed and a new workpiece installed on that gripper assembly.

Accordingly, in the operation of the apparatus 12, as well as the apparatus 150, workpieces are loaded onto the respective supports comprising the gripper assemblies 28, or heads 156, at the load/unload station 30 and then, as the table 18 is rotatably indexed, the workpieces are heated in two stages at the heater units 24. As a workpiece is further indexed rotatably with the table 18, it has liquid applied thereto at the applicator assembly 26 and then, through successive indexings, the workpieces are allowed to reside on the apparatus 12 or 150 to permit the liquid coating or "varnish" to cure through successive indexings until the workpiece returns to the load/unload station 30, whereupon it is removed from the apparatus.

Those skilled in the art will also recognize from the foregoing description that the number of workpiece support heads disposed on the rotary table may be varied to suit the particular type of workpiece being processed by the apparatus 12 or 150. Still further, the number of induction heater units may be increased or decreased depending on the working conditions and the type of liquid being applied to the workpiece. Moreover, the number of liquid "varnish" applicator assemblies or stations may be increased also, depending on the number of workpiece support heads being used.

Still further, application of a liquid coating to a workpiece could be carried out in a different manner. For example, in place of or in addition to the "trickle" applicator assembly 26, the workpiece could be indexed into a position above a tank containing a liquid to be applied to the workpiece. The tank would be mounted on a suitable movable support connected to an actuator which would raise the tank into a position such that at least a portion of the workpiece would be immersed in the liquid. Continued rotation of the workpiece would result in application of a liquid coating to the entire workpiece. After at least one complete revolution of the workpiece the aforementioned tank would be actuated to retract downwardly out of the way of the workpiece so that the workpiece and its support head could be indexed to the next position and replaced by the next workpiece to be treated in accordance with the invention.

Referring now to FIGS. 10A through 10C, there is illustrated a schematic diagram of major components of a control system for operating the apparatus 12 or 150. As shown in FIG. 10A, electrical poser at 110 volts AC or 220 volts AC, for example, may be applied across lines 220 and 222 by way of a main on/off switch 224 together with an operator actuated emergency stop switch 226, a remote emergency stop switch 228 and a low air pressure shutoff switch 230 which are interconnected in series to a main control relay 232. Varnish applicator unit 129 may be supplied with electrical power by way of a suitable connector 234. A suitable DC power supply unit 236 is interposed in the circuit of FIG. 10A, as shown, to provide DC output voltage to the motor 44 and other components as illustrated in FIG. 10A. Speed control for controlling the motor 44 is provided by a suitable DC motor control unit 238.

The overall operation of the apparatus 12 or 150 is adapted to be controlled by two interconnected programmable logic controllers forming a controller assembly 240, FIG. 10A, such as Model PLC 1000-L32BWA programmable logic controllers which are commercially available from Micrologix. A control relay 242 is operated by a switch 244 and when switch 244 is closed, the system for controlling the apparatus 12 or 150 is enabled. When switch 244 is open, rotation of the workpieces continues but rotational indexing of the table 18 ceases and the induction heaters 24 are deenergized and moved to their retracted positions until switch 244 is closed again. When switch 244 is closed, an enable signal is provided to one programmable logic controller assembly 240 and motor 44 is enabled through a control relay 248, FIG. 10B, as an output signal from programmable logic controller number one of the controller assembly 240. Concomitantly, the varnish or lacquer applicator assembly 129 is enabled through a control relay 250, FIG. 10B, and the induction heaters 24 are both enabled through a control relay 252, as also shown in FIG. 10B. The rotary indexing unit 50 is also energized by way of a solenoid operated valve having a solenoid operator 254, and the actuators 60 for each of the heater units 24 are energized by a suitable solenoid operated valve having a solenoid operator 256, FIG. 10B.

FIG. 10B also illustrates, schematically, input signal conductors for one of the programmable logic controllers (#1) of the controller assembly 240 wherein, when a switch 258 is actuated, an operating cycle of the apparatus 12 or 150 is commenced. Conversely, if switch 260 is actuated the controller assembly 240 will stop an operating cycle. A cycle pause switch 262 is operable to provide an input signal to the controller assembly 240. If a fault condition occurs with the applicator unit 129 an input signal is provided to the programmable logic controller assembly 240 by way of a switch 264. "Home" and "index complete" limit switches 266 and 268 are also adapted to provide input signals to the controller assembly 240.

As shown in FIG. 10C, each of the gripper assemblies 28 is independently controllable by way of one programmable logic controller (#2) of the controller assembly 240 wherein solenoid operators 270*a* through 270*l* are provided for respective solenoid operated valves 143 associated with each of the gripper assemblies. As shown in FIG. 10B, the solenoid operator for the solenoid operated valve 143 associated with gripper assembly "number one" is indicated at reference number 270*m* and receives an output signal from the controller assembly 240. The controller assembly 240 is operable, when enabled and when a cycle start signal is input thereto, to rotatably index the table 18 one station position with respect to the support heads or housings 20 followed by the energizing the cylinder actuators 88 and 106 associated with the support housing 20 at station 30 for a predetermined period of time. Simultaneously, the induction heaters 24 are actuated to move into their working positions by their respective cylinder actuators 60 for a predetermined period of time and the liquid applicator assembly 26 is energized to apply a liquid coating to the work piece 14 at the position of the applicator assembly, again for a predetermined period of time. When the aforementioned period of time has elapsed liquid applicator 129 ceases to apply liquid to the workpiece in position for receiving same, the induction heaters 24 are retracted out of working positions, the gripper assembly 28 at station 30 is energized to grip the new workpiece mounted thereon and the actuator 106 associated with that support housing is energized to begin rotation of the workpiece connected thereto.

Suitable limit switches, not shown, may be provided and associated with the induction heaters 24 to signal that the induction heaters have been retracted out of working positions so that the table 18 may be indexed. When signals from such limit switches are received by the controller assembly 240, the rotary actuator 50 is energized to index the table 18 one position whereupon the cycle described above repeats itself.

The apparatus 12 and the apparatus 150 may be constructed using conventional engineering materials and practices known to those of ordinary skill in the art in automated manufacturing machinery, except as otherwise noted herein.

Although preferred embodiments of the invention have been described in detail herein, those skilled in the art will also recognize that various substitutions and modifications may be made to the invention without departing from the scope and spirit of the appended claims.

What is claimed is:

1. Apparatus for applying a liquid coating to conductor windings of a workpiece, comprising:

a frame;

a table rotatably supported on said frame and supporting a plurality of spaced-apart workpiece supports for plural workpieces to be disposed on said apparatus, said table being rotatably indexable from a position of respective ones of said workpiece supports at a load/unload station to a workstation for applying a liquid coating to said windings, each of said workpiece supports including a workpiece support member which is rotatable relative to said table;

a drive mechanism operably connected to each of said workpiece support members for rotating said workpieces, respectively, said drive mechanism comprising a drive motor operably connected to plural drive shafts, respectively, for rotating said drive shafts simultaneously, each of said drive shafts being operable to be drivingly connected to and disconnected from a workpiece support member mounted for rotation on said table and supporting a workpiece; and means for applying a liquid coating to respective ones of said workpieces at said workstation when said table is rotatably indexed from one position to another for each of said workpiece supports.

2. The apparatus set forth in claim 1 wherein:

said means for applying a liquid coating comprises a liquid applicator unit disposed adjacent said table and operable to apply a liquid coating to said workpiece in response to rotatable indexing of said table to place a workpiece adjacent said liquid applicator unit.

3. The apparatus set forth in claim 2 wherein:

said liquid applicator unit includes at least one nozzle disposed to inject a liquid coating material onto said workpiece in response to said workpiece being placed adjacent said one nozzle.

4. The apparatus set forth in claim 3 wherein:

said one nozzle is connected to a source of liquid coating material under a predetermined pressure of application of said liquid coating material through said one nozzle to said workpiece.

5. Apparatus for applying a liquid coating to conductor windings of a workpiece, comprising:

a frame;

a table rotatably supported on said frame and supporting a plurality of spaced-apart workpiece supports for plural workpieces to be disposed on said apparatus, said table being rotatably indexable from a position of respective ones of said workpiece supports at a load/unload station to a workstation for applying a liquid coating to said windings, each of said workpiece supports including a workpiece support member which is rotatable relative to said table;

a drive mechanism operably connected to each of said workpiece support members for rotating said workpieces, respectively, said drive mechanism comprises a ring gear mounted coaxial with an axis of rotation of said table and a drive motor operably connected to plural drive shafts, respectively, each of said drive shafts being adapted to be operably connected to a workpiece support member mounted for rotation on said table and supporting a workpiece; and means for applying a liquid coating to respective ones of said workpieces at said workstation when said table is rotatably indexed from one position to another for each of said workpiece supports.

6. The apparatus set forth in claim 5 wherein:

each of said drive shafts includes a pinion meshed with said ring gear for rotatably driving a workpiece support member associated therewith.

7. Apparatus for applying a liquid coating to conductor windings of a workpiece, comprising:

a frame;

a table rotatably supported on said frame and supporting a plurality of spaced-apart workpiece supports for plural workpieces to be disposed on said apparatus, said table being rotatably indexable from a position of respective ones of said workpiece supports at a load/unload station to a workstation for applying a liquid coating to said windings, each of said workpiece supports including a workpiece support member which is rotatable relative to said table;

a drive mechanism operably connected to each of said workpiece support members for rotating said workpieces, respectively, said drive mechanism comprises a drive motor operably connected to plural drive shafts, respectively, each of said drive shafts being adapted to be operably connected to a workpiece support member mounted for rotation on said table and supporting a workpiece, and said drive mechanism includes means for operably disengaging said workpiece support member from said drive mechanism to cease rotation of said workpiece; and means for applying a liquid coating to respective ones of said workpieces at said workstation when said table is rotatably indexed from one position to another for each of said workpiece supports.

8. The apparatus set forth in claim 7 wherein:

each of said workpiece support members includes shaft means mounted for rotation on a support housing disposed on said table.

9. The apparatus set forth in claim 8 wherein:

said drive mechanism comprises a friction wheel mounted for engagement with and disengagement from said shaft means, respectively.

10. The apparatus set forth in claim 9 including:

a support member for said friction wheel mounted on said apparatus for movement between a position for engaging said friction wheel with said shaft means of said workpiece support member and disengagement therefrom and a drive engagement actuator operably connected to said support member for said friction wheel for moving said friction wheel into and out of engagement with said shaft means.

11. The apparatus set forth in claim 10 wherein:

said drive engagement actuator comprises a pressure fluid operated actuator.

12. The apparatus set forth in claim 8 wherein:

said shaft means of said workpiece support member comprises a pressure fluid actuator rotatably mounted on said support housing and including an actuator member for operating a gripper assembly to releasably grip said workpiece.

13. The apparatus set forth in claim 12 wherein:

said gripper assembly includes a plurality of gripper fingers for releasably gripping said workpiece and supported for rotation on said support housing and said actuator for said gripper assembly is operable to effect actuation of said fingers to grip and release said workpiece, respectively.

14. The apparatus set forth in claim 13 wherein:

each of said fingers is connected to actuating linkage interconnecting said fingers with said actuator member for moving said fingers radially inwardly and outwardly to release and grip said workpiece.

15. The apparatus set forth in claim 10 wherein:

said drive engagement actuator and an actuator for actuating a gripper assembly for said workpiece are pressure fluid actuators and are interconnected with a supply of pressure fluid for simultaneous actuation to grip a workpiece and effect rotation of said workpiece, respectively.

16. The apparatus set forth in claim 15 including:

a pressure fluid rotary coupling mounted on said frame for conducting pressure fluid to each workpiece support member for actuation of said gripper actuator and said drive engagement actuator, respectively.

17. Apparatus for applying a liquid coating to conductor windings of a workpiece, comprising:

a frame;

a table rotatably supported on said frame and supporting a plurality of spaced-apart workpiece supports for plural workpieces to be disposed on said apparatus, said table being rotatably indexable from a position of respective ones of said workpiece supports at a load/unload station to a workstation for applying a liquid coating to said windings, each of said workpiece supports including a workpiece support member which is rotatable relative to said table;

a drive mechanism operably connected to each of said workpiece support members for rotating said workpieces, respectively;

means for applying a liquid coating to respective ones of said workpieces at said workstation when said table is rotatably indexed from one position to another for each of said workpiece supports; and at least a first workpiece heater unit operable to move between a working position and a non-working position in response to rotatable indexing of said table to heat a workpiece prior to application of a liquid coating thereto.

18. The apparatus set forth in claim 17 including:

an actuator for moving said first heater unit between said working position and said non-working position in response to rotatable indexing of said table.

19. The apparatus set forth in claim 18 including:

a second heater unit disposed adjacent said first heater unit and including an actuator for moving said second heater unit between working and non-working positions for heating a workpiece.

20. Apparatus for applying a liquid coating to conductor windings of a workpiece, comprising:

a frame;

a table rotatably supported on said frame and supporting a plurality of spaced-apart workpiece supports for plural workpieces to be disposed on said apparatus, said table being rotatably indexable from a position of respective ones of said workpiece supports at a load/unload station to a workstation for applying a liquid coating to said windings, each of said workpiece supports including a workpiece support member which is rotatable relative to said table;

a drive mechanism operably connected to each of said workpiece support members for rotating said workpieces, respectively;

means for applying a liquid coating to respective ones of said workpieces at said workstation when said table is rotatably indexed from one position to another for each of said workpiece supports; and a first workpiece heater unit operable to heat a workpiece prior to application of a liquid coating thereto.

21. The apparatus set forth in claim 20 including:

an actuator for moving said first heater unit between a working position and a non-working position in response to rotatable indexing of said table.

22. The apparatus set forth in claim 21 including:

a second heater unit disposed adjacent said first heater unit and including an actuator for moving said second heater unit between working and non-working positions for heating a workpiece.

23. The apparatus set forth in claim 20 wherein:

said means for applying said liquid coating comprises a liquid applicator unit disposed adjacent said table and operable to apply a liquid coating to said workpiece in response to rotatable indexing of said table to place a workpiece adjacent said liquid applicator unit.

24. The apparatus set forth in claim 23 wherein:

said liquid applicator unit includes at least one nozzle disposed to inject a liquid coating material onto said workpiece in response to said workpiece being placed adjacent said one nozzle.

25. The apparatus set forth in claim 24 wherein:

said one nozzle is connected to a source of liquid coating material under a predetermined pressure of application of said liquid coating material through said one nozzle to said workpiece.

26. Apparatus for applying a liquid coating to conductor windings of a workpiece, comprising:

a frame;

a table rotatably supported on said frame and supporting a plurality of spaced-apart workpiece supports for plural workpieces to be disposed on said apparatus, said table being rotatably indexable from a position of respective ones of said workpiece supports at a load/unload station to a workstation for applying a liquid coating to said windings, each of said workpiece supports including a workpiece support member which is rotatable relative to said table;

a drive mechanism operably connected to each of said workpiece support members for rotating said workpieces and for ceasing rotation of said workpieces, respectively, said drive mechanism comprising a drive motor drivingly connected to plural drive shafts, respectively, each of said drive shafts being adapted to be operably connected to a workpiece support member mounted for rotation on said table and supporting a workpiece, respectively; and means for applying a liquid coating to respective ones of said workpieces at said workstation when said table is rotatably indexed from one position to another for each of said workpiece supports.

27. The apparatus set forth in claim 26 wherein:

said drive mechanism comprises a ring gear mounted coaxial with an axis of rotation of said table.

28. The apparatus set forth in claim 27 wherein:

each of said drive shafts includes a pinion meshed with said ring gear for rotatably driving a workpiece support member associated therewith.

29. The apparatus set forth in claim 26 wherein:

each of said workpiece support members includes shaft means mounted for rotation on a support housing disposed on said table.

* * * * *